US006744415B2

(12) United States Patent
Waterman et al.

(10) Patent No.: US 6,744,415 B2
(45) Date of Patent: Jun. 1, 2004

(54) SYSTEM AND METHOD FOR PROVIDING VOLTAGES FOR A LIQUID CRYSTAL DISPLAY

(75) Inventors: John Karl Waterman, Mesa, AZ (US); Russell Flack, Scottsdale, AZ (US); Terry Klein, Averill Park, NY (US); Andreas Grubert, Houston, TX (US)

(73) Assignee: Brillian Corporation, Tempe, AZ (US)

( * ) Notice: Subject to any disclaimer, the term of this patent is extended or adjusted under 35 U.S.C. 154(b) by 68 days.

(21) Appl. No.: 09/915,172

(22) Filed: Jul. 25, 2001

(65) Prior Publication Data

US 2003/0025663 A1 Feb. 6, 2003

(51) Int. Cl.[7] ..... G09G 3/36

(52) U.S. Cl. ..... 345/87; 345/88; 345/89; 345/93; 345/94; 345/95; 345/100; 345/101; 345/204; 345/208; 345/210; 345/211; 345/690; 345/699

(58) Field of Search ..... 345/87, 88, 89, 345/93, 94, 95, 100, 101, 699, 204, 208, 210, 211, 690

(56) References Cited

U.S. PATENT DOCUMENTS

| | | | | |
|---|---|---|---|---|
| 5,956,006 A | * | 9/1999 | Sato | 345/88 |
| 6,373,419 B1 | * | 4/2002 | Nakao | 341/154 |
| 2002/0036609 A1 | * | 3/2002 | Kajihara et al. | 345/87 |

* cited by examiner

*Primary Examiner*—Richard Hjerpe
*Assistant Examiner*—Jean Lesperance
(74) *Attorney, Agent, or Firm*—Baker Botts L.L.P.

(57) ABSTRACT

A matrix of liquid crystal pixels (160) is provided. A digital-to-analog converter (DAC) (150) is coupled to the matrix and produces an output voltage that can be applied to one or more pixels in the matrix. The DAC (150) receives a multi-bit digital input and generates its output voltage to correspond to the digital input. The conversion function of the DAC is adapted to have a higher resolution within a voltage range in which most grayshade changes of the LCD occur.

8 Claims, 6 Drawing Sheets

SYSTEM AND METHOD FOR PROVIDING VOLTAGES FOR A LIQUID CRYSTAL DISPLAY

FIELD OF THE INVENTION

The present invention relates generally to liquid crystal display devices, and more particularly to a digital to analog converter for providing a voltage for driving a display screen of a liquid crystal display device pixels accurately shaded in correspondence with a digital or analog video signal.

BACKGROUND OF THE INVENTION

Liquid crystal displays (LCDs) are commonly used in devices such as portable televisions, portable computers, control displays, and cellular phones to display information to a user. LCDs act in effect as a light valve, i.e., they allow transmission of light in one state, block the transmission of light in a second state, and some include several intermediate stages for partial transmission. When used as a high resolution information display, as in one embodiment of the present application, LCDs are typically arranged in a matrix configuration with independently controlled pixels. Each individual pixel is signaled to selectively transmit or block light from a backlight (transmission mode), from a reflector (reflective mode), or from a combination of the two (transflective mode).

An LCD pixel can control the transference for different wavelengths of light. For example, an LCD can have pixels that control the amount of transmission of red, green, and blue light independently. In some LCDs, voltages are applied to different portions of a pixel to control light passing through several portions of dyed glass. In other LCDs, different colors are projected onto the pixel sequentially in time. If the voltage is also changed sequentially in time, different intensities of different colors of light result. By quickly changing the wavelength of light to which the pixel is exposed an observer will see the combination of colors rather than sequential discrete colors. Several monochrome LCDs can also result in a color display. For example, a monochrome red LCD can project its image onto a screen. If a monochrome green and monochrome blue LCD are projected in alignment with the red, the combination will be full color.

The monochrome resolution of an LCD can be defined by the number of different levels of light transmission that each pixel can perform in response to a control signal. A second level is different from a first level when the user can tell the difference between the two. An LCD with greater monochrome resolution will look clearer to the user.

LCDs are actuated pixel-by-pixel, either one at a time or several simultaneously. A voltage is applied to each pixel and the liquid crystal responds to the voltage by transmitting a corresponding amount of light. In some LCDs an increase in the actuation voltage decreases transmission, while in others it increases transmission. When multiple colors are involved for each pixel, multiple voltages are applied to the pixel at different positions or times depending upon the LCD. Each voltage controls the transmission of a particular color. For example, one pixel can be actuated to allow only blue light to be transmitted while another allows only green. A greater number of different light levels available for each color results in a much greater number of possible color combination.

Converting a complex digital signal that represents an image or video into voltages to be applied to the pixels of an LCD involves circuitry that can limit the monochrome resolution. The signals necessary to drive a single color of an LCD are both digital and analog. It is digital in that each pixel requires a separate selection signal, but it is analog in that an actual voltage is applied to the pixel to determine light transmission. The conversion from a bit-representation of the desired light transmission, as communicated in the image or video signal, to an actual voltage that controls the light transmission can introduce errors that reduce the monochrome resolution of the LCD. For example, if a Digital-to-Analog Converter (DAC) takes as an input a bit-representation of voltage that includes 1024 voltage levels and outputs voltages between 0 and 16 volts, the ideal output levels would differ by 16 millivolts (mV). However, the electro-optical curve (EO curve) has most of the gray shade changes occur in voltages about 1V to 2V on either side of the center voltage of the display. In other words, a linear increase of the voltage provided by the DAC does not necessarily reflect the same increase in gray shade. In the specific region mentioned above, the sensitivity preferably should be about 4 times higher, in the above mentioned example, about 4 mV.

SUMMARY OF THE INVENTION

The embodiments of the present application are directed to a system and method for providing a control voltage for driving a liquid crystal display.

In one embodiment of the present application, a matrix of liquid crystal pixels is provided. A digital-to-analog (DAC) converter is coupled to the matrix and produces an output voltage that can be applied to one or more pixels in the matrix. The DAC receives multi-bit digital input and generates an output voltage according to its conversion function corresponding to the digital input. The conversion function of the DAC is specifically adapted to provide an optimum resolution within a voltage range in which most of the gray changes on the LCD occur.

In another embodiment the DAC comprises a non-linear conversion function which, for example, can be divided into a plurality of linear sub-ranges. The transition from one sub-range to an adjacent sub-range is non-linear.

The DAC, as shown in one or more embodiments, can consist of a plurality of standard DACs and a control logic which switches between the DACs to provide the different sub-ranges. Two or more DAC, can also be combined according to another embodiment of the present application.

In yet another embodiment the DAC comprises a comparator and an inverter coupled with a digital signal. Furthermore, the first switching circuit is controlled by the comparator for selecting the digital signal or the inverted digital signal are provided. An adder for adding a constant coupled with the switching circuit and a first digital-to-analog converter being coupled with the adder are also provided. For generating a second resolution a second digital-to-analog converter is coupled with the first switching circuit and second switching circuit are controlled by the adder for selecting one of the digital-to-analog converters. An offset unit is coupled with the second switching circuit and third switching circuit are controlled by the comparator for selection between the second switching circuit and the offset unit.

Other technical advantages of the present disclosure will be readily apparent to one skilled in the art from the following figures, descriptions, and claims. Various embodiments of the present application obtain only a subset of the advantages set forth. No one advantage is critical to the embodiments. For example, one embodiment of the present application may only provide the advantage of controlling the pixels of a liquid crystal display, while other embodiments may provide several of the specified and apparent advantages.

BRIEF DESCRIPTION OF THE DRAWINGS

A more complete understanding of the present disclosure and advantages thereof may be acquired by referring to the following description taken in conjunction with the accompanying drawings, in which like reference numbers indicate like features, and wherein.

DETAILED DESCRIPTION OF THE PREFERRED EMBODIMENTS

Figure 1:
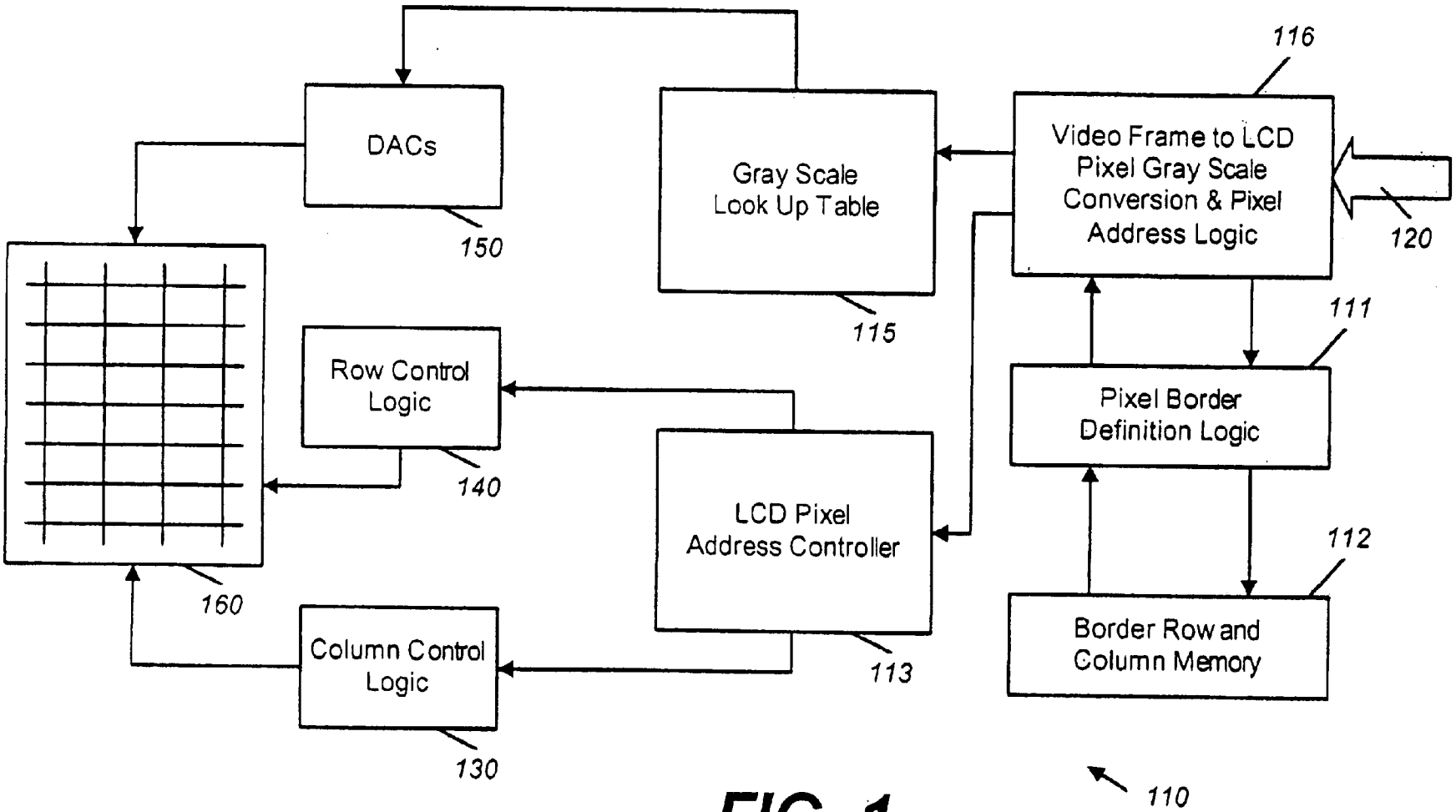
FIG. 1 is a block diagram of a liquid crystal display driver circuitry in accordance with one embodiment of the present application.

Turning to the drawings, exemplary embodiments of the present application will now be described. FIG. 1 depicts a high-level block diagram of a LCD driver system represented by the numeral 110 for actuating pixels of a liquid crystal display screen 160 in accordance with video data. A liquid crystal display 160 is usually arranged in a matrix of rows and columns as indicated in FIG. 1. A video software program may access stored data representing an image or series of images. The video software program locates pixel-specific information in the stored data according to its protocol. For example, the data may be stored in Apple Corporation's Quicktime format, Microsoft Corporation's Media Player format, MPEG-2 standard format, and the like. The video software outputs pixel-specific digital data 120, for example, for 256 gray shades. The signal 120 can also provide color information instead of gray shade information. In another embodiment, the software program receives video data directly from an optical recording device such as a video camera.

One or more DACs 150 are adapted to receive digital amplitude information from a gray scale look up table 115. The gray scale look up table 115 receives pixel grayscale information from the video frame to LCD pixel address and gray scale conversion logic 116 which is adapted to convert video information 120 into corresponding pixel information (grayscale and pixel address information). Pixel address information is sent to an LCD pixel address controller 113 which is adapted to control the row control logic 140 and column control logic 130. The gray scale look up table 115 determines the necessary gray scale value.

The video information 120 is received by LCD driver system 110. The driver system 110 converts the video information 120 from an analog or digital format to pixel-specific gray-scale voltages. In one embodiment, a single voltage source for each pixel drives a monochrome display. In another embodiment, a pixel has several voltages each for a different color, sequentially applied, in order to drive a full color display. A driver system 110 can be provided for each color (red, green, blue) for which there is video information 120. The driver electronics then provides those pixel charging voltages and control signals to the liquid crystal display 160. Each pixel-charging voltage corresponds to one pixel of one image.

The liquid crystal display 160 receives voltages to individual pixels and, in some embodiments, for particular colors for each pixel. The liquid crystal display 160 is adapted to select pixels of which voltages are applied in accordance with received control signals. The voltages change the light transfer characteristics of the pixels. The collective visual impact of the selectively lighted pixels portrays an image.

The driver system 110 is usually integrated into an ASIC design. Preferably, a 10-bit DAC may be used with such a design. Such a DAC typically outputs 12 mA full-scale current in 12 mA/1024=12 $\mu$A steps. Since this current is used to create the control voltage for each pixel, 16V/1024=16 mV steps can be achieved. However, the electro-optical curve (EO curve) has most of the grayshade changes occur in voltages from about 1 V to 2V on either side of the center voltage of the display. Over that sensitive 1V region, only 1V/16 mV=60 steps can be provided by a standard DAC configuration. To get true 256 grayshade performance, or the respective color resolution in a color LCD application, a sensitivity in that specific region which is 4 times higher than the usual sensitivity is needed.

The following figures depict several embodiments which fulfill the above requirements. One way to improve the sensitivity of a DAC is to provide different voltage ranges with different accuracies. The following table shows different voltage ranges for a DAC:

TABLE 1

| Output Voltage | Resolution | Steps |
|---|---|---|
| 0–5.82 V | 64 mV | 91; from 0–90 |
| 5.82 V–7.5 V | 4 mV | 421; from 91–511 |
| 7.5 V–8.5 V | — | no steps |
| 8.5 V–10.18 V | 4 mV | 421; 512–932 |
| 10.18 V–16 V | 64 mV | 91; 932–1023 |

An exemplary embodiment will be explained below using an implementation of Table 1. Of course, other implementations are possible and the actual implementation should be adapted to the respective requirements and the EO curve of the particular LCD. For example, Table 2 illustrates other exemplary implementations for LCD's.

TABLE 2

| Fine Voltage | Fine steps | Fine range | Coarse voltage | Coarse steps | Coarse range | No step range |
|---|---|---|---|---|---|---|
| 4 mV | each 318 | 6.23–7.5; 8.5–9.77 | 32 mV | each 194 | 0–6.23; 9.77–16 | 7.5–8.5 |
| 4 mV | each 421 | 5.82–7.5; 8.5–10.18 | 64 mV | each 91 | 0–5.82; 10.18–16 | 7.5–8.5 |
| 5 mV | each | 5.92–7.5; | 30 mV | each 195 | 0–5.92; | 7.5–8.5 |

TABLE 2-continued

| Fine Voltage | Fine steps | Fine range | Coarse voltage | Coarse steps | Coarse range | No step range |
|---|---|---|---|---|---|---|
| | 317 | 8.5–10.08 | | | 10.08–16 | |
| 5 mV | each 371 | 5.65–7.5; 8.5–10.35 | 40 mV | each 141 | 0–5.65 8.516 | 7.5–8.5 |
| 6 mV | each 409 | 5.05–7.5; 8.5–10.95 | 36 mV | each 103 | 0–5.05; 10.95–16 | 7.5–8.5 |
| 6 mV | each 364 | 5.32–7.5; 8.5–10.68 | 48 mV | each 148 | 0–5.32; 10.68–16 | 7.5–8.5 |

Figure 2:
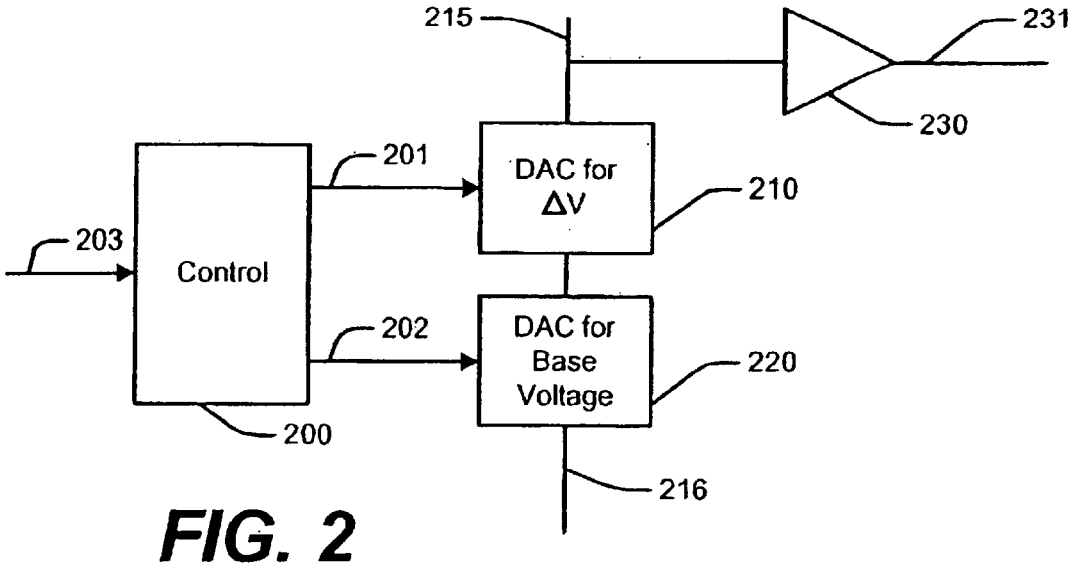
FIG. 2 is a block diagram of a DAC in accordance with one embodiment of the present application.

FIG. 2 depicts a first exemplary embodiment of a DAC suitable for carrying out the above described characteristics. A control unit 200 receives, for example a 10-bit digital voltage signal 203. Control unit 200 has all the necessary components to control a first DAC 210 for providing a ΔV and a second DAC 220 for providing a base voltage. DAC 210 and DAC 220 are coupled in series between supply terminals 215 and 216. Both DAC 210 and 220 provide a output voltage between their output terminals which are summed and coupled to a amplifier circuit 230. Therefore, e.g., terminal 216 may be ground and terminal 215 the analog supply voltage. The generated output voltage by this arrangement is fed to terminal 231. DAC 220 comprises the necessary elements to generate four base voltages to provide the non-linear conversion rate shown in Table 1. The first base voltage is 0V, the second 5.82 V, the third 7.5, and the fourth 10.18 V. Depending on the range in which the input signal 203 lies, control unit 200 generates for example a two-bit output signal 202 which controls DAC 220 and selects the respective base voltage. DAC 210 provides in addition a ΔV which is added to the base voltage. One of the control lines 201 is used to select the resolution with which DAC 210 will generate its output voltage. In this exemplary embodiment, two resolutions are selectable, namely 4 mV and 64 mV. In this embodiment, 9 bits are used to generate the 421 fine steps and 7 bits to generate the 91 coarse steps. DAC 210 may have two separate DAC's or a combined DAC to provide these ΔV steps. Control unit 200 operates according to the input signal 203 to select the respective base voltage and the respective ΔV added to the base voltage to generate an output voltage according to Table 1.

Figure 3:
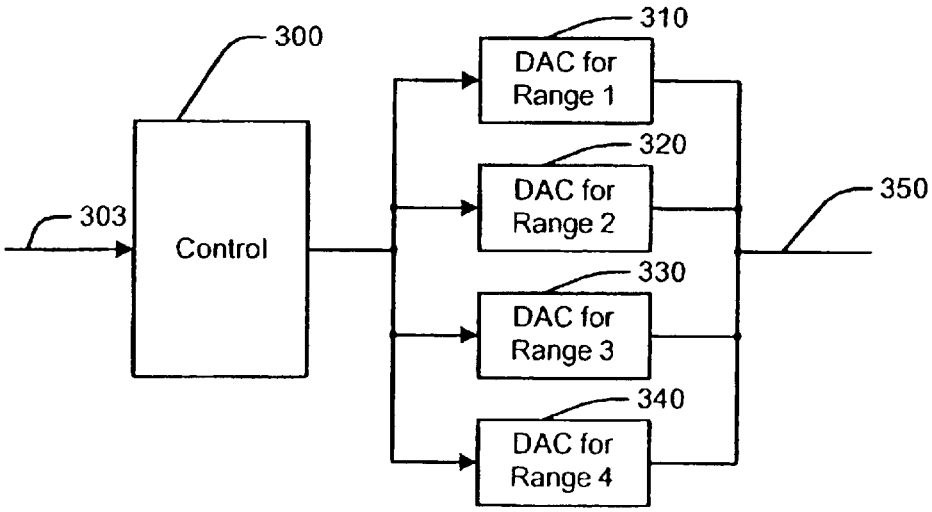
FIG. 3 is a block diagram of a DAC in accordance with another embodiment of the present application.

FIG. 3 depicts a second exemplary embodiment to generate output voltages according the Tables 1 and 2. In this embodiment 4 different DAC's 310, 320, 330, and 340 are used to provide output voltages. A control unit 300 receives a digital input signal 303 and accordingly selects one of the DAC's 310, 320, 330, and 340. The DAC's 310, 320, 330, and 340 are constructed to either disconnect their output or couple it with terminal 350 so that the output signals of the four DAC's 310, 320, 330, and 340 do not interfere with each other. Whenever one of the DAC's 310, 320, 330, and 340 has been selected by control unit 300 it provides a respective output voltage at terminal 350. To this end, DAC 310 receives 7 input bits and generates an output voltage between 0 and 5.82 V. DAC 320 receives 9 input bits and generates an output voltage between 5.82 V and 7.5V. DAC 330 receives 9 input bits and generates an output voltage between 8.5 V and 10.18 V. Finally, DAC 330 receives 7 input bits and generates an output voltage between 10.18 V and 16 V.

Figure 4:
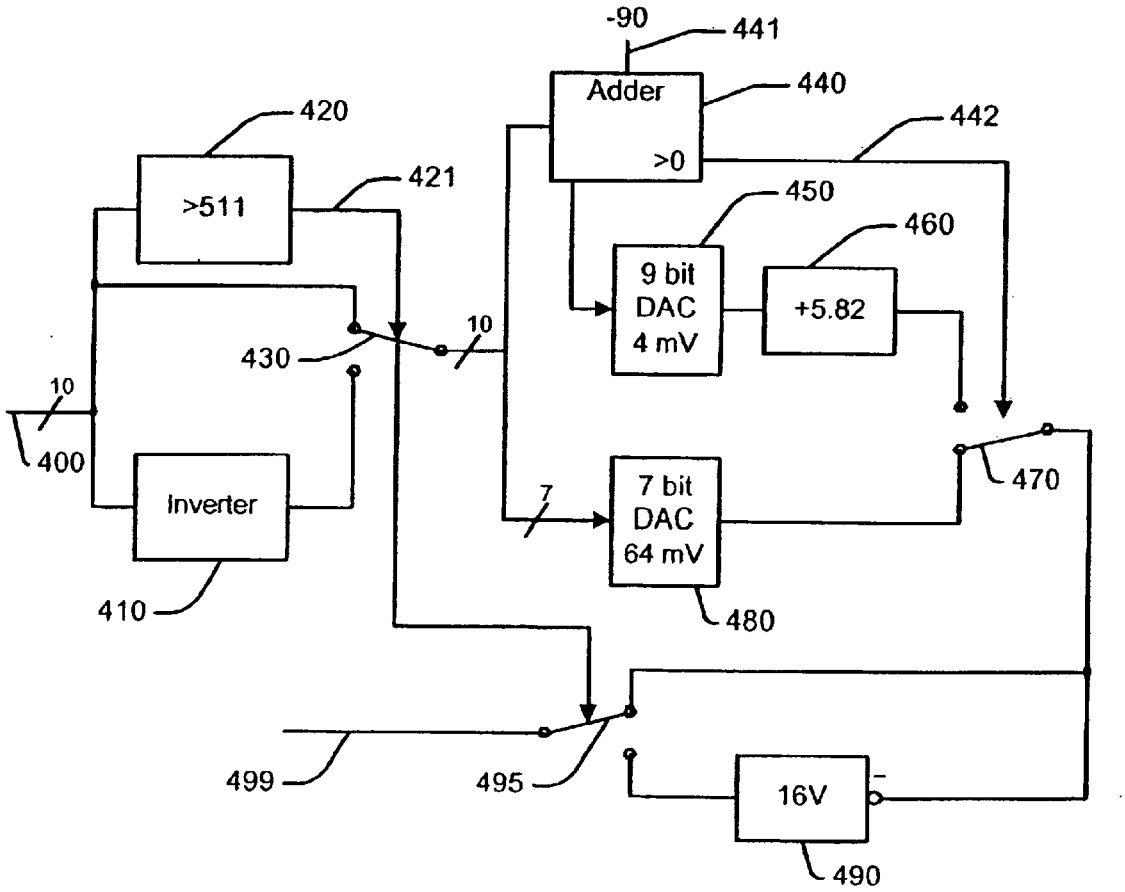
FIG. 4 is a more detailed block diagram of a DAC in accordance with yet another embodiment of the present application.

FIG. 4 depicts another embodiment in more detail. This embodiment, in particular, reduces elements needed to provide a DAC with a non-linear conversion function. At terminal 400 a digital input signal is fed which consists of 10 bits to provide a resolution of 1024 steps. This terminal 400 is coupled with the input of a digital inverter 410, a digital comparator 420, and a first input of a switch 430. The output of inverter 410 is connected with the second input of switch 430. Comparator 420 generates an output signal 421 which controls switch 430. The output of switch 430 is fed to the first input of an adder 440 and the input of a 7-bit DAC 480. the second input of adder 440 is coupled with a digital constant of −90. At the output of adder 440 a control signal 442 is generated which controls a switch 470 whose first input is coupled to the output of DAC 480. The output of adder 440 is connected with the input of a 9-bit DAC 450 whose output is coupled to the input of an offset unit 460. DAC 450 can be designed to incorporate offset unit 460. The output of offset unit 460 is connected with the second input of switch 470. The output of switch 470 is coupled to the first input of a third switch 495 and the negating input of another offset unit 490 whose output connects to the second input of switch 495. The output of switch 495 is coupled to terminal 499. Switch 495 is controlled by control signal 421 provided by comparator 420.

If the input signal lies between 0 and 90, comparator 420 compares this input 400 with the digital number 511. As it is less than 511 it controls the switch 430 to couple its output directly to the input signal 400. Adder 440 adds the digital constant −90 to this input. Therefore, its output will be a number between −90 and 0. The control output (>0) of adder 440 generates a two state signal depending on whether the output is greater than 0 or equal to less than 0. In this case the control signal will control switch 470 to switch to the output of DAC 480 which now generates an output signal between 0 and 5.82 V depending on the lower 7 bits of input signal 400. Switch 495 which is also controlled by signal 421 directly couples this analog output signal to terminal 499.

If the input signal lies between 91 and 511, then comparator 420 still generates a control signal which directly couples the input signal 400 with adder 440 and DAC 480 and directly couples the output of switch 470 with terminal 499 via switch 495. However, Adder 440 will now generate a different control signal which couples the output of offset unit 460 with the output of switch 470. The output of adder 440 now carries the difference of input signal 400 minus 90. This difference is fed to DAC 450 which generates an analog output voltage fed to offset unit 460. Offset unit 460 adds 5.82 volts to this output voltage. The result which lies between 5.82 and 7.5 V is fed to terminal 499.

If the input signal lies between 512 and 932, then comparator 420 will generate a control signal 421 that couples the output of switch 430 with the output inverter 410. Inverter 410 will generate in this case a output signal between 511 and 91, respectively. Adder 440, DAC 450, offset unit 460, DAC 480, and switch 470 will operate as described with respect to range 91–511, above. Therefore, the output voltage at the output of switch will lie between 7.5 and 5.82 V, respectively. However, switch 495 is controlled by signal 421 and now couples the output of offset unit 490 with terminal 499. Therefore, the output voltage of switch 470 is fed to offset unit 490 through the negating input with an inverted algebraic sign. Thus the output voltage of switch 470 is effectively subtracted from the offset voltage of 16 V. The resulting output voltage which is fed to terminal 499 therefore lies between 8.5 and 10.18 V.

If the input signal 400 lies between 933–1023, again comparator 420 generates a signal that effectively couples the output of inverter 410 with the output of switch 430. The inverted input signal now lies between 90 and 0, respectively. All other elements operate as described above. Again offset unit 490 will be selected by switch 495 and the resulting output voltage will lie between 10.18 and 16 V.

Figure 5:
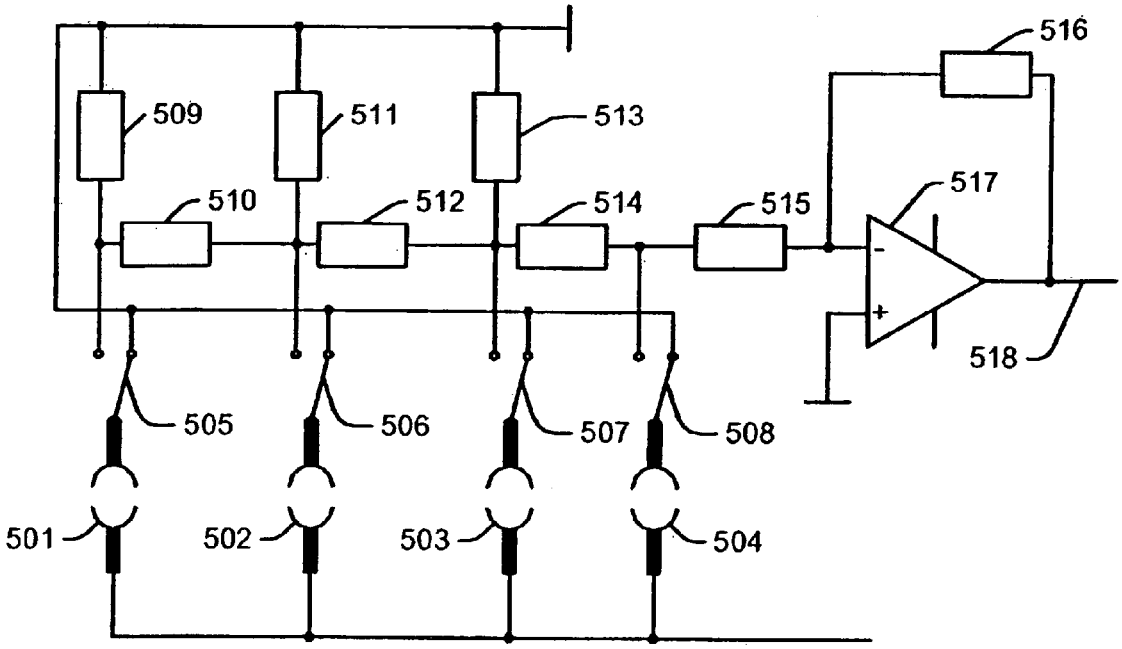
FIG. 5 is a circuit diagram of a standard DAC which can be used with any embodiment according to the present application.

FIG. 5 depicts a standard DAC according to the R-2R principle which can be used, for example, as DAC 480 and/or DAC 450. A DAC according to FIG. 5 needs 2(n–1)+1 resistors and n switches, whereby n designates the number of bits. FIG. 5 depicts, for example, a 4-bit DAC. Resistors 509, 510, 512, 514 and 515 each have a value of R and resistor 511 and 513 each have a value of 2R. Resistor 516 has a value of 3R/2. This kind of DAC is usually ideal integration, because the resistor network can be realized very precisely using the matching principle. The resistor network functions in a way that the potential at the respective nodes is divided by two, respectively due to the currents which are separated by the switches 505–508 and the current sources 501–504. The operational amplifier 517 then converts the current at the negative input of operational amplifier 517 into an output voltage at terminal 518.

Figure 6:
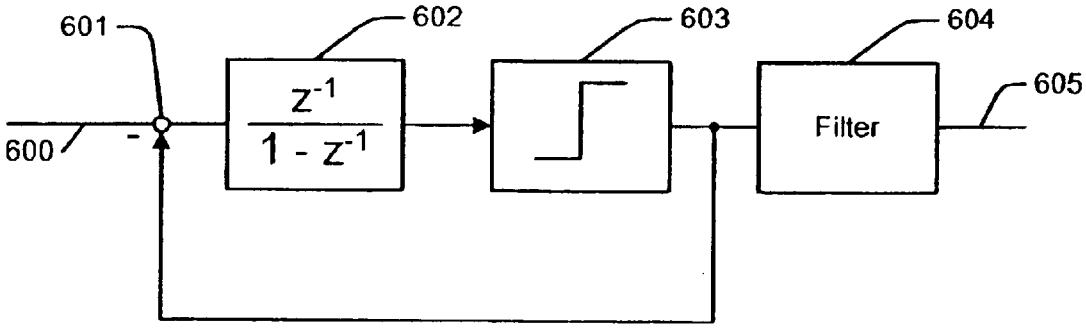
FIG. 6 is a circuit diagram of another standard DAC which can be used with any embodiment according to the present application.

Another possible exemplary embodiment of a DAC is shown in FIG. 6. This DAC is a sigma-delta digital-to-analog-converter. Sigma-delta DACs are very well known in the literature and therefore will not be explained here. A sigma-delta modulator, generally consists of an integrator 602 and a comparator 603, with a 1-bit DAC in a feedback loop and a filter 604.

Figure 7:
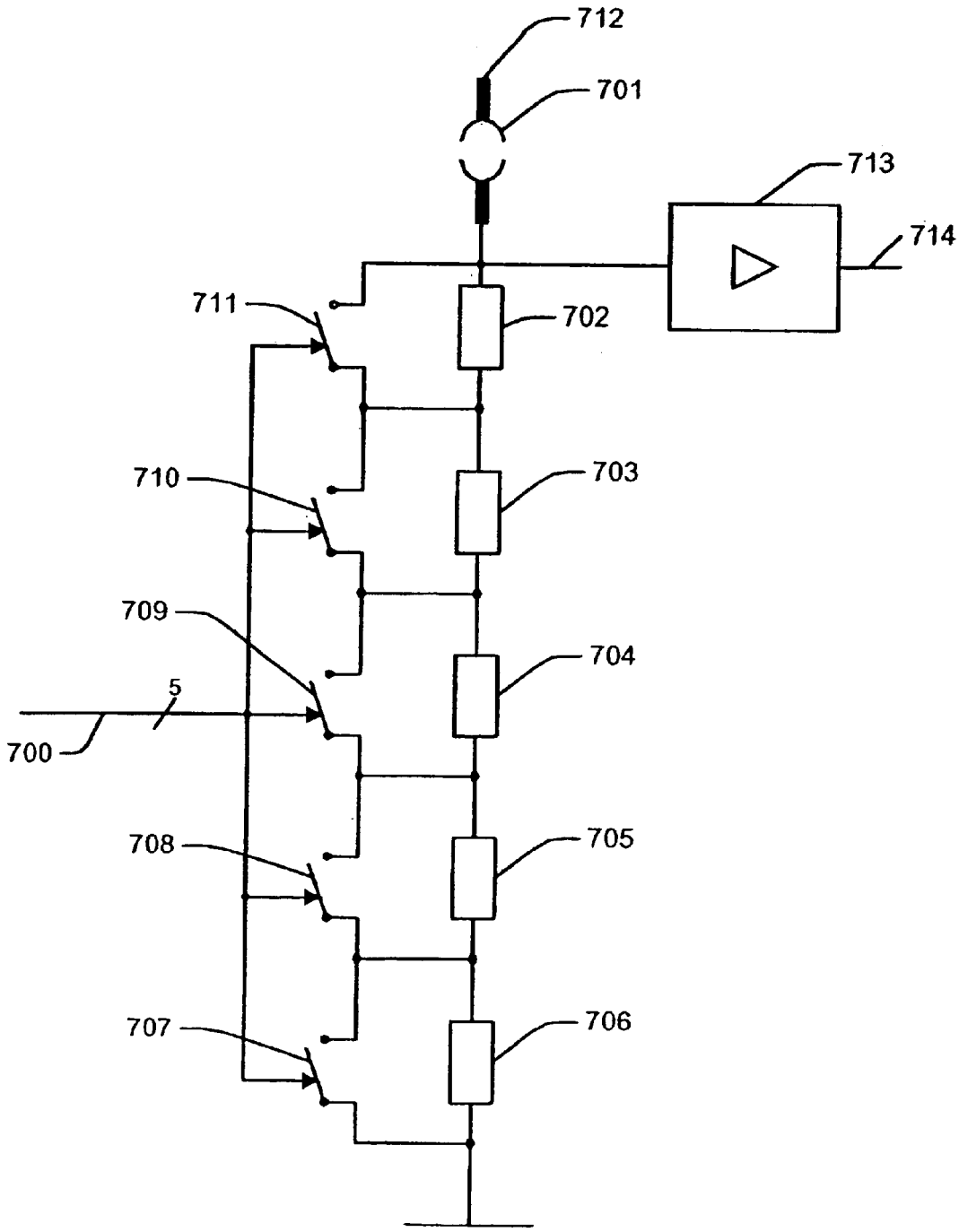
FIG. 7 is a circuit diagram of yet another standard DAC which can be used with any embodiment according to the present application.

FIG. 7 depicts another simple embodiment of a DAC. The DAC according to FIG. 7 comprises a current source 701 and a plurality of resistors 702–706 connected in series. In parallel to each resistor is coupled a switch 707–711, respectively. The switches are controlled by the input signal 700 which comprises 5 bits in this exemplary embodiment. The output signal is taken from the node between current source 701 and the first resistor 702 and fed to the input of an amplifier 713. The output of amplifier 713 is coupled to terminal 714. Resistors 702–706 are designed to each have the double value of its predecessor. For example, resistor 706 has a value of R, resistor 705 a value of 2R, resistor 704 a value of 4R, etc.

Figure 8:
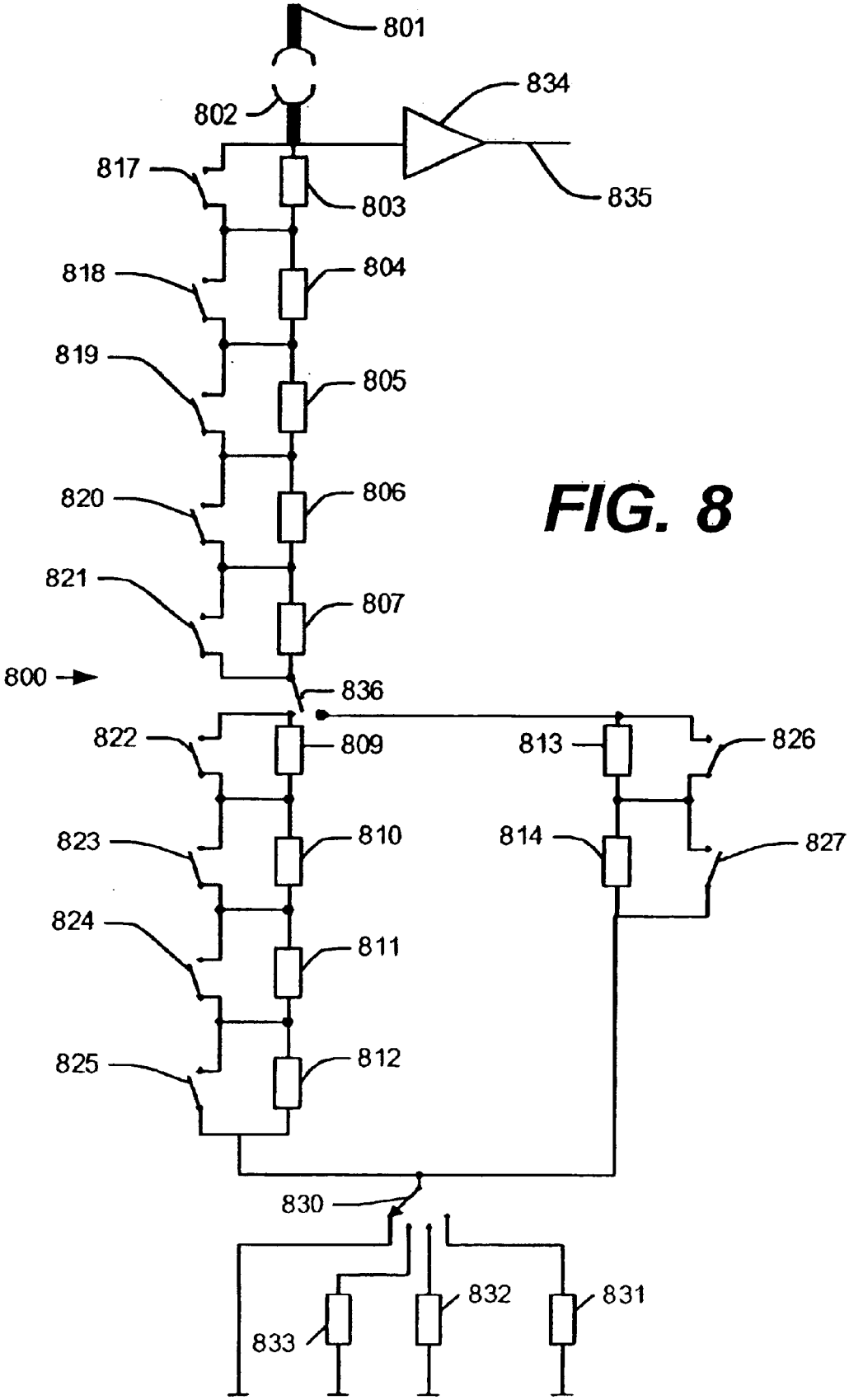
FIG. 8 is a circuit diagram of another embodiment of a DAC according to the present application.

According to the principle shown in FIG. 7, FIG. 8 depicts an embodiment of a DAC. Again, this embodiment implements the non-linear conversion function of Table 1. A first network of resistors 803–807 is coupled in series between a current source 802 coupled with a supply voltage 801 and a common terminal of a first select switch 836. In parallel to each resistor 803–807 is placed a switch 817–821, respectively. The first select terminal of select switch 836 is coupled with a second network of resistors 809–812, again with switches 822–825 coupled in parallel to each resistor 809–812. A third network of resistors 813–814 and respective switches 826–827 is coupled between the second select terminal of switch 836 and the common terminal of a second select switch 830 which is also connected to the second network through resistor 812 and associated switch 825. Switch 830 comprises four select terminals. The first one is directly connected to the ground, the second one is coupled through resistor 833, the third through resistor 832 and the fourth through resistor 831 with ground, respectively. The input of amplifier 834 is coupled with the node between the first resistor 803 of the first network and the current source 802.

A control unit (not shown) provides the necessary control signals for all switches 817–827, 830, and 836. The principle of this embodiment is similar to the one shown in FIG. 2. Select switch 830 selects a base voltage which is either 0 V, 5.82 V, 8.5 V, or 10.18 V. Current source provides in all scenarios always a constant current. Therefore, the voltage across the different resistors is always constant. Resistors 831–833 are designed to generate the above mentioned base voltages with the constant current generated by current source 802. Resistors 803–812 are designed to generate multiples of $2^n$ of 4 mV. Therefore, resistor 812 has a value to generate 4 mV, resistor 811 has a value to generate 8 mV, resistor 810 has a value to generate 16 mV up to resistor 803 which has a value to generate 1024 mV. These 9 resistors 903–812 are used to generate the ΔV with a resolution of 4 mV. For the second DAC a resolution of 64 mV is needed. This DAC consists of elements 803–807 and 817–821 from the first DAC and additional resistors 826 and 827 and switches 813 and 814. The second resistor network 809–812 and switches 822–825 providing the fine resolution up to 60 mV are not needed for the second DAC. Therefore, select switch 836 disconnects this network from the first network and couples the first network with the third network. The third network comprises only two resistors 826 and 827 with respective switches 813 and 814. These resistors 826 and 827 are responsible for the voltage steps 2048 mV and 4096 mV which are needed for the second DAC. The control unit generates all the necessary signals to couple the three networks to form the two DAC's and generate the respective voltages according to Table 1.

While the present embodiments are susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims. For example, more or less voltage ranges can be implemented to adapt to the respective EO curves of a LCD. Each sub-range might comprise a logarithmic conversion function instead of a linear function. A plurality of DAC's with non-linear conversion function might be provided to generate control voltages for color displays. Each color pixel might have a different EO curve. Therefore, different DAC's can be implemented.

What is claimed is:

1. A system for actuating a liquid crystal display (LCD), comprising:

a matrix of liquid crystal pixels in a liquid crystal display (LCD);

a first digital-to-analog converter (DAC) having an output with a course step resolution; and a second DAC having an output with a fine step resolution, wherein the first and second DAC outputs are combined to apply pixel charging voltages to the matrix of liquid crystal pixels, the pixel charging voltages being representative of a video signal, the first DAC output has a first plurality of voltage ranges and the second DAC output has a second plurality of voltage ranges, wherein the second plurality of voltage ranges are within the first plurality of voltage ranges and have smaller voltage range increments than the voltage range increments of the first plurality of voltage ranges, and the first and second DACs each comprise a first network having a plurality of resistors coupled in series and a plurality of switches coupled in parallel with each resistor, a second network having a plurality of resistors coupled in series and a plurality of switches coupled in parallel with each resistor, a third network having a plurality of resistors coupled in series and a plurality of switches coupled in parallel with each resistor, switching means to couple said first network with either said second network or said third network in series between a power supply, a current source coupled in series with said first network, and control means for controlling said switches.

2. A system according to claim 1, wherein the second plurality of voltage ranges are where most grayshade changes of the matrix of liquid crystal pixels occur.

3. A system according to claim 1, wherein the first DAC digital input has a different number of bits then the second DAC digital input.

4. A system according to claim 1, wherein the first and second DAC outputs are combined with a switching means.

5. A system according to claim 1, wherein the first DAC comprises a plurality of first DACs and the second DAC comprises a plurality of second DACs.

6. A system according to claim 1, further comprising select switching means coupled in series with said networks for selecting an offset voltage out of a plurality of offset voltages.

7. A system for actuating a liquid crystal display (LCD), comprising:

a matrix of liquid crystal pixels in a liquid crystal display (LCD);

a first digital-to-analog converter (DAC) having an output with a course step resolution; and a second DAC haying an output with a fine step resolution, wherein the first and second DAC outputs are combined to apply pixel charging voltages to the matrix of liquid crystal pixels, the pixel charging voltages being representative of a video signal, the first DAC output has a first plurality of voltage ranges and the second DAC output has a second plurality of voltage ranges, wherein the second plurality of voltage ranges are within the first plurality of voltage ranges and have smaller voltage range increments than the voltage range increments of the first plurality of voltage ranges, and the first and second DACs each comprise:

a comparator coupled with the video signal;

an inverter coupled with the video signal;

first switching means being controlled by said comparator for selecting the video signal or the inverted video signal;

an adder for adding a constant coupled with said switching means;

the first DAC being coupled with said adder;

the second DAC being coupled with said first switching means;

second switching means being controlled by said adder for selecting one of the first or second DACs;

an offset unit coupled with said second switching means; and third switching means being controlled by said comparator for selecting between said second switching means and said offset unit.

8. A system according to claim 7, wherein the first DAC is coupled with a second offset unit.

* * * * *